US006688083B1

(12) United States Patent
Fitzgibbons et al.

(10) Patent No.: US 6,688,083 B1
(45) Date of Patent: Feb. 10, 2004

(54) DROP CONTROL MECHANISM FOR FLAT ARTICLES

(75) Inventors: Patrick J. Fitzgibbons, Newark Valley, NY (US); Douglas A. Slocum, New Milford, PA (US); Louis B. Taylor, Apalachin, NY (US)

(73) Assignee: Lockheed Martin Corporation, Bethesda, MD (US)

( * ) Notice: Subject to any disclaimer, the term of this patent is extended or adjusted under 35 U.S.C. 154(b) by 270 days.

(21) Appl. No.: 09/715,352

(22) Filed: Nov. 17, 2000

(51) Int. Cl.[7] ..... B65H 29/68

(52) U.S. Cl. ..... 53/501; 53/502; 53/503; 53/504; 271/207; 271/213; 271/218

(58) Field of Search ..... 53/501, 502, 503, 53/504, 241, 244, 252, 260, 540; 221/68, 93, 95, 99, 206, 295; 83/157, 167, 90; 271/189, 218, 306, 215, 1, 2, 3.04, 3.06, 207, 213

(56) References Cited

U.S. PATENT DOCUMENTS 3,585,777 A * 6/1971 Pesch ..... 53/397
4,229,134 A * 10/1980 Reist ..... 414/790.3
4,249,844 A * 2/1981 Lampe et al. ..... 414/790
4,469,321 A * 9/1984 Geschwindner ..... 271/189
4,740,193 A * 4/1988 Frost et al. ..... 493/82
5,368,288 A * 11/1994 Philipp et al. ..... 271/215
5,435,541 A * 7/1995 Fornay et al. ..... 271/189
5,538,140 A * 7/1996 Guenther et al. ..... 271/189
5,769,413 A 6/1998 Hummel et al.
6,322,315 B1 * 11/2001 Schmidt et al. ..... 414/789.9

* cited by examiner

*Primary Examiner*—Rinaldi I. Rada
*Assistant Examiner*—Brian Nash
(74) *Attorney, Agent, or Firm*—Wolf, Greenfield & Sacks, P.C.

(57) ABSTRACT

This invention provides a mechanism for receiving flat articles, such as mail, moving in a travel path with a substantially horizontal orientation and for dropping selected such articles into either a single receptacle positioned below the mechanism or into a plurality of receptacles spaced along the length of the travel path, while maintaining the substantially horizontal article orientation for all such articles. The mechanism includes a holding station for each receptacle into which each article to be dropped is initially deposited, the holding station being just below the travel path, a retractable floor for the holding station and a driver selectively operable for rapidly retracting the floor in a substantially horizontal direction to permit articles accumulated in the holding station to drop substantially vertically into the corresponding receptacle. The driver may be activated in response to the holding station being filled by a selected amount. Where there are plurality of holding stations, a separate driver may be provided for each, or two or more of the holding stations may be operated by a single driver.

10 Claims, 5 Drawing Sheets

DROP CONTROL MECHANISM FOR FLAT ARTICLES

FIELD OF THE INVENTION

This invention relates to systems and mechanisms for handling flat articles such as mixed mail and, more particularly, to a mechanism which maintains the face orientation of such articles as they are dropped from a transport mechanism into a receptacle.

BACKGROUND OF THE INVENTION

In systems for processing or otherwise handling mail, particularly mixed mail, or other flat articles, such articles are frequently diverted from an existing transport path and dropped into a suitable receptacle. An example of this is, for example, the sorting of mail by zip code, or the sorting of other articles such as flat parts, audio, video or computer discs, audio tapes and the like by part or item number. It is frequently desirable that the face orientation of the article remain unchanged after such drop to facilitate further processing of the articles at, for example, another location. For example, mail going to a given five-digit zip code might be sorted and bundled and then sent to a central post office at such zip code where it can be further sorted automatically by 11-digit zip code address or the like. Mail in such a package having the same orientation greatly facilitates such downstream processing.

However, since such articles are frequently discharged down an angled chute and can have a drop from the chute to the receiving receptacle of a foot or more, the aerodynamics of a flat article are such that both the face which is exposed at the bottom of the fall and the orientation of such face may undergo substantial change during the fall. While some mechanisms have heretofore been used to minimize this problem, these mechanisms have taken up considerable space in the vertical direction, thereby increasing the vertical footprint of each receptacle station and reducing the number of layers of such stations which can be accommodated in a given space by as much as 50%. Further, while these devices sometimes reduce the angle of the articles at the beginning of the drop, seeking to maintain the articles substantially horizontal at the beginning of the drop, they also can add close to a foot to the article drop distance, this added drop distance increasing the likelihood of a face orientation change for the article during the drop.

A need therefore exists for an enhanced mechanism for controlling the drop of flat articles from a transport and handling mechanism for such articles into an appropriate receptacle at various drop stations along an article handling transport system, which mechanism has as small a vertical footprint as possible so as to minimize any increase in vertical dimension caused by the presence of such device, while substantially assuring that the drop does not alter the face orientation of the article.

SUMMARY OF THE INVENTION

In accordance with the above, this invention provides a mechanism for receiving flat articles moving in a travel path with a substantially horizontal orientation and for dropping selected such articles into a receptacle position below the mechanism while maintaining the substantially horizontal article orientation for all such articles. The mechanism includes a holding station into which each article to be dropped is initially deposited, the holding station being just below the travel path; a retractable floor for the holding station; and a driver selectively operable for rapidly retracting the floor in a substantially horizontal direction to permit articles accumulated in the holding station to drop substantially vertically into the receptacle. The floor of the holding station may be a shutter slidable in a substantially horizontal plane between a first position under the holding station, and a second position out from under the holding station. Alternatively, the floor may be an iris mechanism having an extended position under the holding station and a retracted position out from under the holding station. The driver may, for example, be a pneumatic or hydraulic cylinder and may be operated, for example, in response to the holding station being filled by a selected amount, for example a selected thickness of articles or a selected number of articles in the holding station.

Where there are a plurality of receptacles positioned below the mechanism, a holding station of the type indicated above may be provided for each receptacle, which holding station is positioned just below the travel path and over the corresponding receptacle. A separate driver may be included for each of the holding stations or a common driver may be provided for at least a plurality of such holding stations. In the latter case, this driver may be operated in response to one of the holding stations reaching a selected fill level or possibly the passage of a selected time interval since the driver was last operated. Each of the holding stations for an embodiment with multiple holding stations is otherwise substantially the same as the single holding station described above.

The foregoing and other objects, features and advantages of the invention will be apparent from the following more particular description of preferred embodiments of the invention as illustrated in the accompanying drawings, common elements having the same reference numerals in the various drawings.

DETAILED DESCRIPTION

Figure 1:
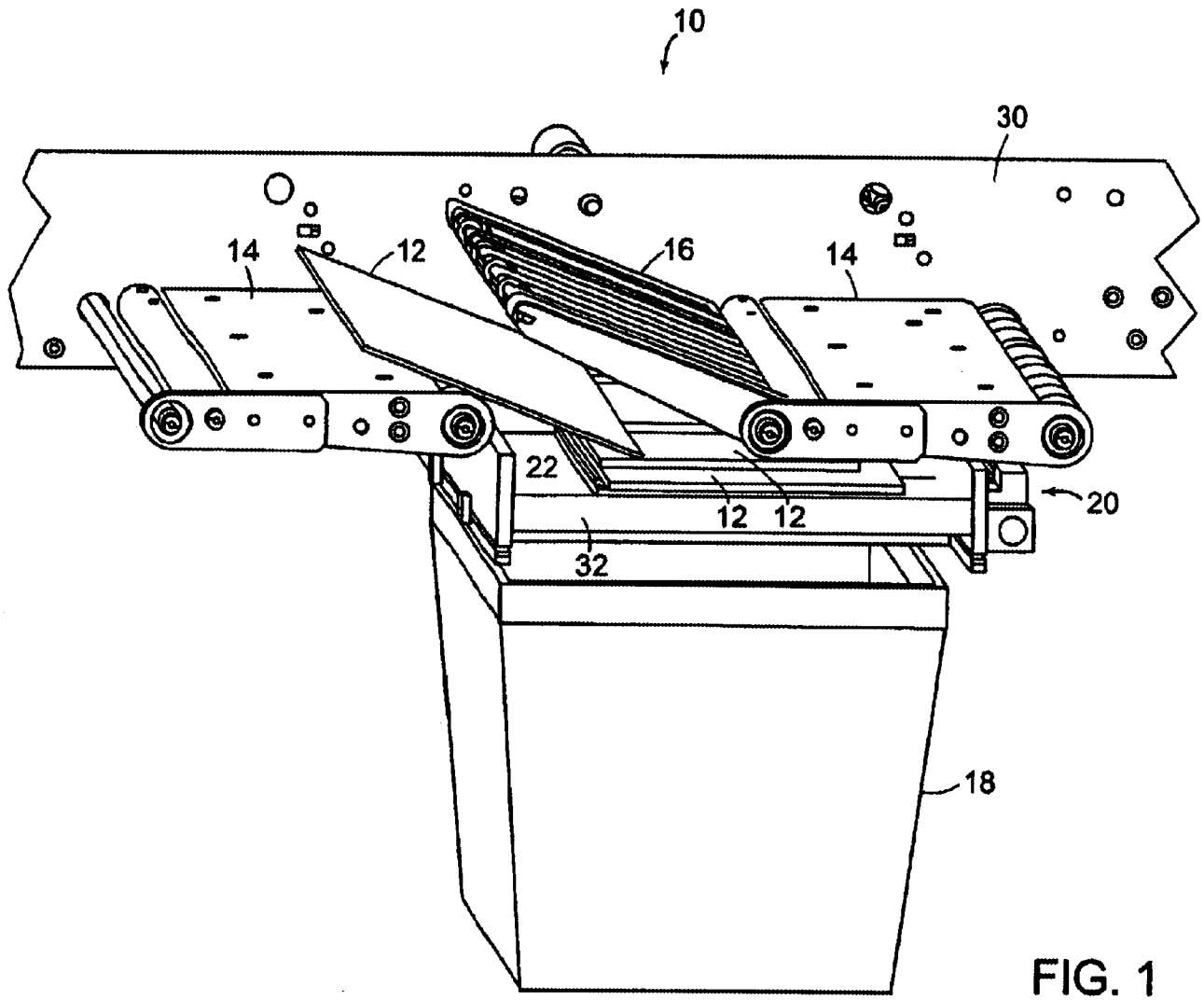
FIG. 1 is a front top perspective view of a single drop station in accordance with a preferred embodiment of the invention.
Figure 2:
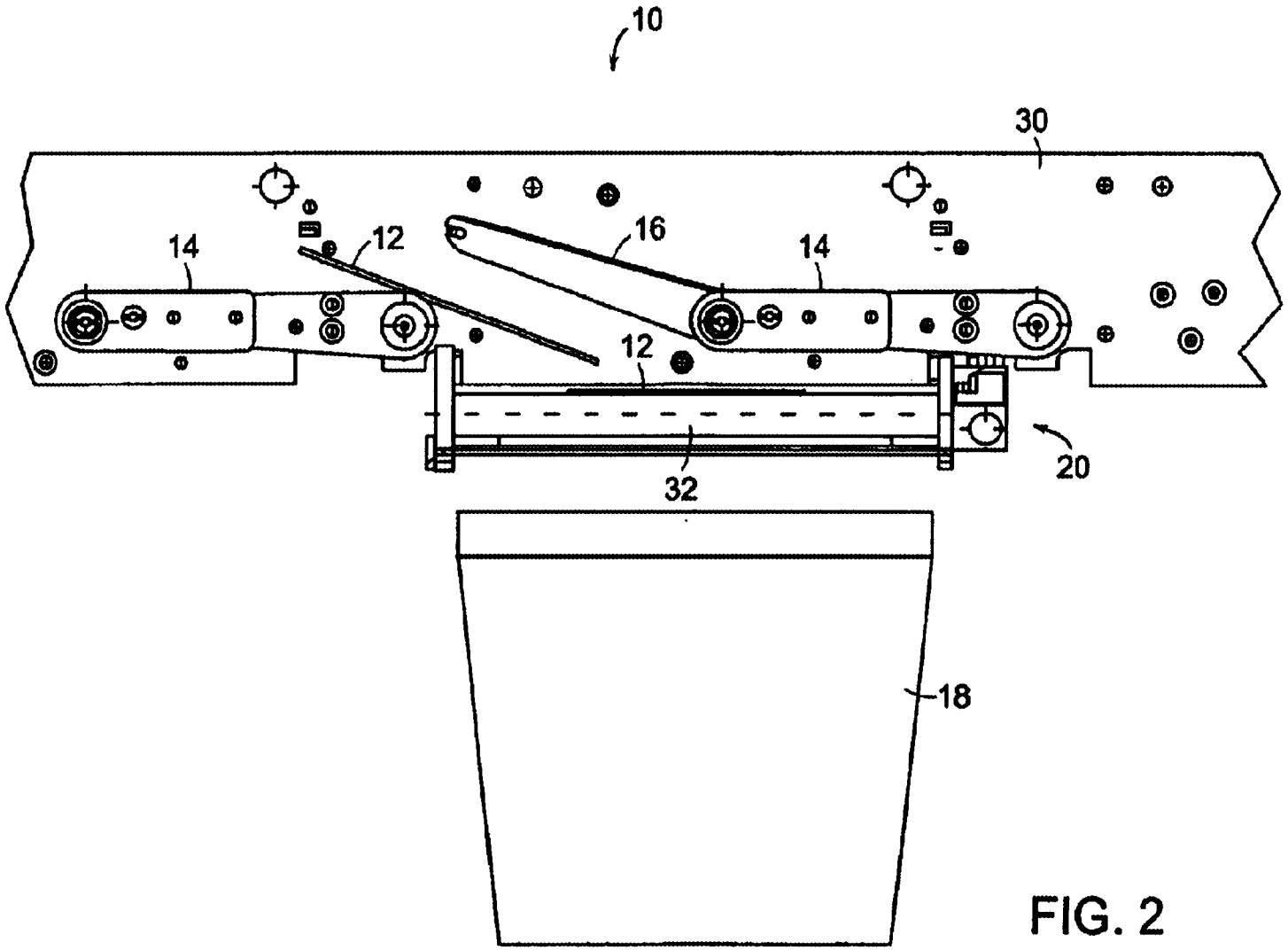
FIG. 2 is a front view of the station shown in FIG. 1 in the position of FIG. 1 with a mail piece entering the station and the drop box or holding station for the drop station being closed.
Figure 3:
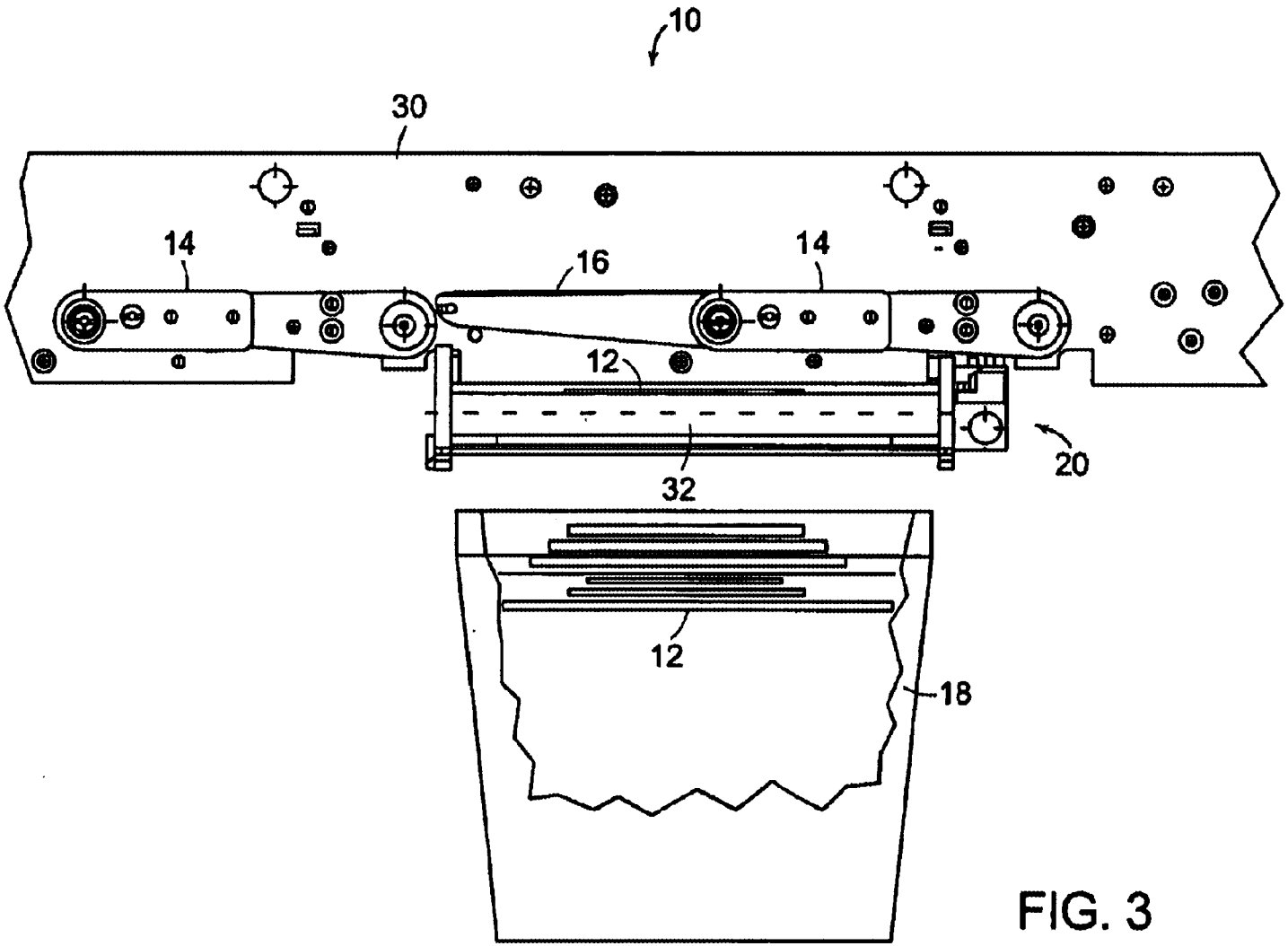
FIG. 3 is a front view of the drop station of FIGS. 1 and 2 with the diverter plate of the station closed, the drop box of the station open and articles falling from the drop box into the receptacle, the receptacle being shown partially cut away.

Referring to the figures and, in particular, FIGS. 1–3, a drop station 10 for flat articles 12 such as mail pieces is shown. Articles 12 normally travel over a transport which includes a pair of drive belts 14, which normally move the articles from left to right as shown in the figures, and a diverter plate 16 between belts 14 which is normally in a lowered position as shown in FIG. 3 so that articles moving along the transport may pass over the diverter plate. Diverter plate 16 is pivoted to a raised position, as shown in FIGS. 1 and 2, when an article approaches drop station 10 which is to be received in a mail tub 18 or in some other suitable receptacle.

The portion of drop station 10 described to this point is standard, the drive mechanisms 14 and diverter mechanism 16 shown in the figures being by way of illustration only, and any of a variety of other suitable transport and diverter mechanisms known in the art also being usable for performing these functions. FIG. 2 illustrates one problem encountered with such prior art systems, namely that, as the mail piece or other article 12 is diverted to receptacle 18, its leading edge tilts downward and this angle increases (i.e., the orientation of the article becomes more vertical) as the article continues to move off the left-hand belt 14 and as the article drops into receptacle 18. Particularly in applications such as the sorting of mixed mail, larger articles may reach the bottom of the receptacle and slide into a position with the same face orientation as existed on belt 14; however, particularly for smaller articles, the angle of the article may become vertical, or even move past vertical so that when the article lands in the receptacle, it may land face down and/or may experience other orientation changes. The purpose of this invention is to minimize the likelihood of any such face orienting change occurring.

To overcome the above problem, the invention includes a holding or drop box 20 having a floor 22 which is positioned below the plane of belts 14 by a distance sufficient to permit a selected quantity of mail or other articles to accumulate therein, but which is short enough so as to minimize any reorientation of the article as it drops therein. For an illustrative mixed mail embodiment, floor 22 is roughly 3" below the bottom surface of belt 14, permitting almost 3" of mail to be accumulated therein. The drop for each mail item from belt 14 to floor 22 is thus roughly 1–3", depending on the quantity of mail already accumulated therein.

Figure 4:
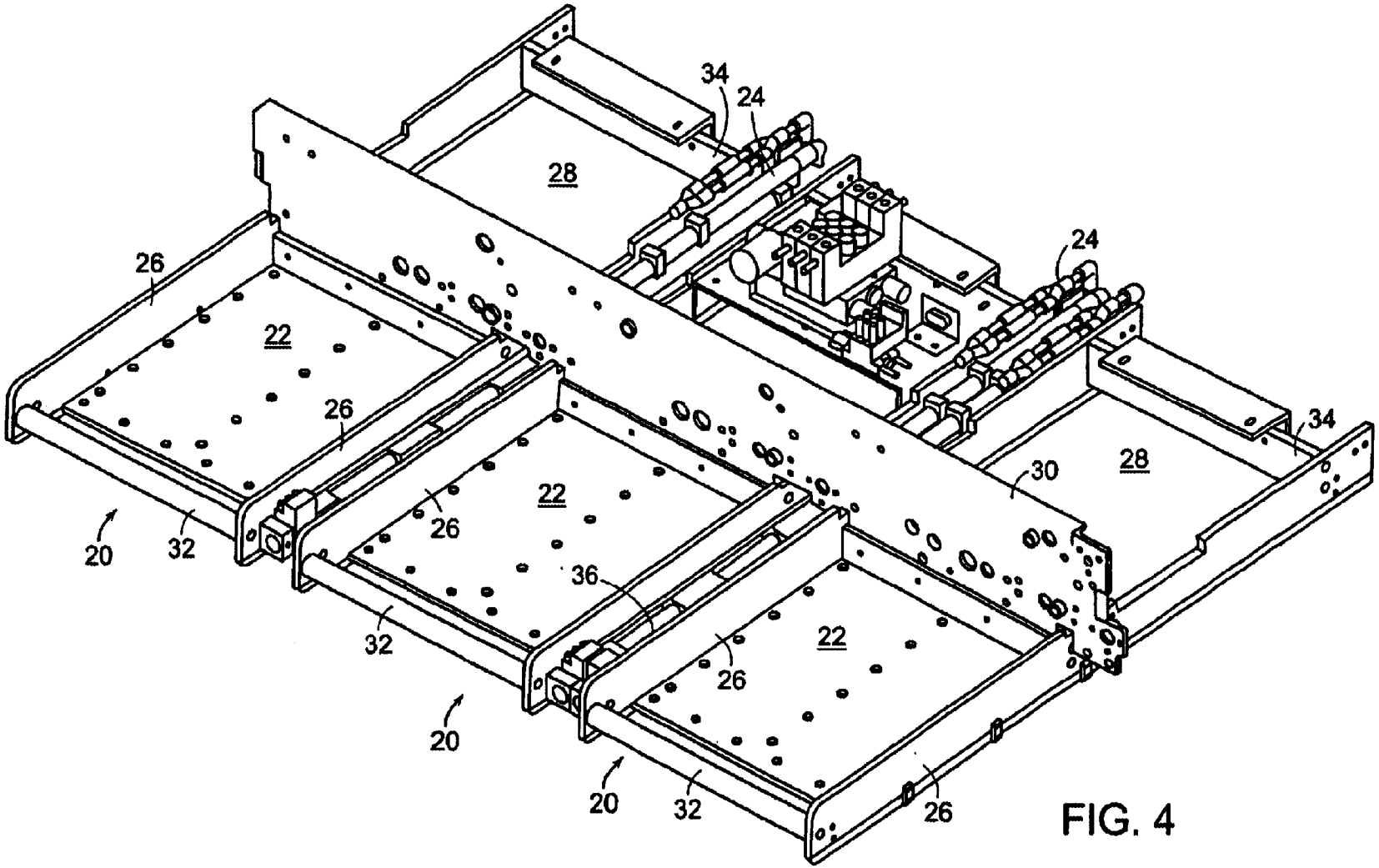
FIG. 4 is a top perspective view of three adjacent drop boxes suitable for use as drop boxes in drop stations of the type shown in FIGS. 1–3.
Figures 5A, 5B, 5C, 5D:
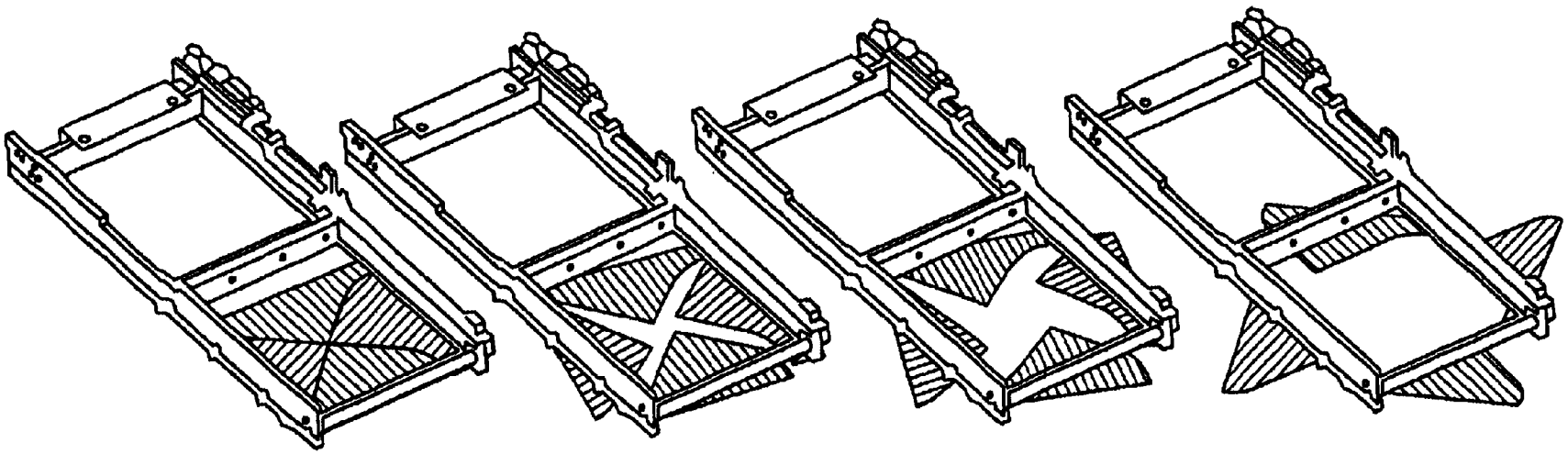
FIGS. 5A–5D are top views of an iris mechanism depicting a progression from an extended position in FIG. 5A to a retracted position in FIG. 5D.

As may be best seen in FIG. 4, a pneumatic cylinder 24 is provided for each floor 22, which floor functions as a shutter, each floor or shutter being mounted between a pair of slide rails 26, and being movable between the positions shown in FIG. 4 and a position in space 28 on the opposite side of wall 30. Spacer bars 32 and 34 are provided on opposite ends of each pair of rails 26 to maintain desired spacing between the rails, and thus to assure free movement of floors 22 therein. Each pneumatic piston 24 terminates in a rod 36 connected by suitable means to the corresponding floor 22, all or a part of which floor may extend through the adjacent slide rail 26, When operated, each piston 24 rapidly retracts the corresponding floor 22 into space 28. Pneumatic pistons 24 may be a single piston and rod, or may be in multiple sections to assure even more rapid retraction. Further, while pneumatic pistons 24 are utilized to control the movement of floor 22 for the illustrative embodiment, other linear movement mechanisms may be employed for this purpose including, but not limited to, hydraulic cylinders, linear motors, linear magnetic actuators and the like. The particular drive mechanism used in a given application will depend on such factors as required retraction speed, cost, and available space. External controls (not shown) are provided to operate pistons 24, for example the same processor which controls operation of diverter plate 16.

While a separate drive mechanism 24,36 has been shown in FIG. 4 for each of the three drop boxes 20 illustrated therein, the drop boxes being aligned one behind the other along the path of the transport, this is not a limitation on the invention, and a single drive mechanism might be utilized to control all three of the floors 22 to retract into openings 28 or to move them back to the position shown in FIG. 4. Floors 22 may be moved in response to a variety of conditions. For example, an optical or other suitable sensor may be provided to determine when the height of letters or other articles in a given drop box 20 reaches a selected level and the drive mechanism 24 for the drop box actuated in response to an output from the sensor. Alternatively, the number of articles dropped into a drop box 20 since the last actuation of the piston could be counted and actuation occur when a selected count is reached. If a single drive is being utilized to control two or more of the drop boxes 20, the level of articles in each drop box could be monitored and drive 24 actuated when the level for any of the boxes is sufficient to require a drop. A timer timing out or reaching a selected value might also be used to actuate the drive mechanism. The article count between actuation of pistons 24 may be controlled based, for example, on the thickness of articles being processed. Other more sophisticated algorithms may also be used to control operation of the various drives 24.

Each door 22 would be opened only momentarily for a time sufficient for articles 12 accumulated in the drop box to drop into receptacle 18. It is preferable that diverter plate 16 not be operated during this period to avoid having a misoriented article fall into receptacle 18. A look-ahead mechanism could be utilized to assure that an article for a station is not about to arrive while floor 22 is open and/or to prematurely open a station and do a drop before arrival of multiple articles for the station. In accordance with the teachings of this invention, the retraction of floor 22 is rapid enough so that the inertia of the stack of articles 12 in drop box 20 maintains the stack in position without any change in orientation until floor 22 has been fully retracted. Gravity then results in the articles 12 dropping straight down as shown in FIG. 3, assuring that the desired article face orientation is maintained.

While for the illustrative embodiment of the figures, floors 22 are shown as being retracted into a space 28, other configurations for the rapid horizontal movement of a floor or floors 22 are also possible. For example, floor 22 could be split, with the drive mechanism operating on each half of the floor to move them in opposite directions. For example, a single pneumatic cylinder could be provided adjacent the center of floor 22 with rods coming out of each end thereof, each rod being attached to one of the two floor sections to drive the sections in opposite directions. The floor may also be in the form of an iris mechanism (FIGS. 5A–5D) a substantially circular mechanism constructed much like a camera shutter and comprising overlapping plates which when in an extended position cover the bottom of drop box 20 and when in a retracted position allow mail to drop into receptacle 18. The latter two mechanisms are somewhat advantageous in that they provide support for the ends of the article stack until the floor has been almost completely removed; however, the added cost and complexity of these arrangements should normally not be required since the floor can generally be removed before gravity affects articles in the drop box.

Thus, a mechanism has been provided for facilitating the dropping of mail or other flat articles into a receptacle from an article transport mechanism which has a relatively small vertical footprint, while substantially assuring that face orientation of all articles, even articles of mixed size, is maintained. While the invention has been described above with reference to an illustrative embodiment, and numerous variations on this embodiment have been discussed, it is to be understood that the discussion above is for purposes of illustration only and that the foregoing and other variations in form and detail may be made thereon by one skilled in the art while still remaining within the spirit and scope of the invention, which is to be defined only by the appended claims.

What is claimed is:

1. A mechanism for receiving flat articles moving in a travel path with a substantially horizontal orientation and for dropping selected such articles into a receptacle positioned below said mechanism while maintaining said substantially horizontal orientations for all said articles, the mechanism including:

a holding station into which each article to be dropped is initially deposited, said holding station being just below said travel path;

a retractable floor comprising only a single member for said holding station, wherein said floor is an iris mechanism having an extended position under said holding station and a retracted position out from under said holding station; and a driver selectively operable for rapidly retracting said floor in a substantially horizontal direction to permit articles accumulated in said holding station to drop substantially vertically into said receptacle.

2. A mechanism as claimed in claim 1 wherein said driver is one of a pneumatic and a hydraulic cylinder.

3. A mechanism as claimed in claim 1 wherein said driver is operated in response to said holding station being filled by a selected amount.

4. A mechanism as claimed in claim 3 wherein said driver is operated in response to one of the holding station being filled to a selected level and a selected number of articles having been deposited in the holding station since the last time the driver was actuated.

5. A mechanism for receiving flat articles moving in a travel path with a substantially horizontal orientation and for selectively dropping such articles into a plurality of receptacles positioned below said mechanism while maintaining said substantially horizontal orientations for all said articles, the mechanism including:

a holding station for each said receptacle, each said holding station being positioned just below said travel path and over the corresponding receptacle, each article to be dropped into a receptacle being initially dropped into the corresponding holding station;

a retractable floor comprising only a single member for each said holding station wherein each said floor is an iris mechanism having an extended position under the corresponding holding station and a retracted position out from under the corresponding holding station; and a driver selectively operable for rapidly retracting each said floor in a substantially horizontal direction to permit articles accumulated in the corresponding holding station to drop substantially vertically into the corresponding receptacle.

6. A mechanism as claimed in claim 5 wherein said driver includes a separate driver for each said holding station.

7. A mechanism as claimed in claim 6 wherein each said driver is one of a pneumatic and a hydraulic cylinder.

8. A mechanism as claim 6 wherein each said driver is operated in response to the corresponding holding station being filled by a selected amount.

9. A mechanism as claimed in claim 5 wherein there is a common driver for at least a plurality of said holding stations.

10. A mechanism as claimed in claim 9 wherein said driver is operated in response to at least one of the holding stations operated by said driver being filled by a selected amount.

* * * * *